US009415919B2

(12) United States Patent
Kuribayashi

(10) Patent No.: US 9,415,919 B2
(45) Date of Patent: Aug. 16, 2016

(54) FLAT BAG STORING SHEET-SHAPED OBJECT

(71) Applicant: TAIKI CORP., LTD., Osaka-shi, Osaka (JP)

(72) Inventor: Yoshimitsu Kuribayashi, Osaka (JP)

(73) Assignee: Taiki Corp., Ltd., Osaka (JP)

( * ) Notice: Subject to any disclaimer, the term of this patent is extended or adjusted under 35 U.S.C. 154(b) by 0 days.

(21) Appl. No.: 14/433,536

(22) PCT Filed: Oct. 4, 2013

(86) PCT No.: PCT/JP2013/077156
§ 371 (c)(1),
(2) Date: Apr. 3, 2015

(87) PCT Pub. No.: WO2014/054800
PCT Pub. Date: Apr. 10, 2014

(65) Prior Publication Data

US 2015/0298881 A1 Oct. 22, 2015

(30) Foreign Application Priority Data

Oct. 4, 2012 (JP) ..... 2012-222101
Oct. 3, 2013 (JP) ..... 2013-208507

(51) Int. Cl.
*B65D 69/00* (2006.01)
*B65D 75/58* (2006.01)
(Continued)

(52) U.S. Cl.
CPC ..... *B65D 75/5855* (2013.01); *A45C 7/00* (2013.01); *A45C 11/00* (2013.01); A45D 40/0087 (2013.01); *A45D 44/002* (2013.01); *A45D 44/22* (2013.01); *B65D 81/22* (2013.01); *A45C 2007/0004* (2013.01); *A45C 2011/007* (2013.01)

(58) Field of Classification Search
CPC ..... B65D 33/00; A61L 2/26; A45C 11/008
USPC ..... 206/210, 205, 207, 494, 440, 438, 484, 206/484.1, 484.2, 581, 823; 383/93, 95, 97, 383/98, 99
See application file for complete search history.

(56) References Cited

U.S. PATENT DOCUMENTS 4,252,238 A * 2/1981 Spiegelberg ..... A61L 9/12 206/260
5,409,115 A * 4/1995 Barkhorn ..... B65D 75/5833 206/440

(Continued)

FOREIGN PATENT DOCUMENTS

JP 3088620 U 9/2002
JP 2006-224974 A 8/2006

(Continued)

OTHER PUBLICATIONS

International Search Report mailed by Japan Patent Office on Dec. 3, 2013 in the corresponding PCT application No. PCT/JP2013/077156—11 pages.

*Primary Examiner* — Jacob K Ackun
*Assistant Examiner* — Jenine Pagan
(74) *Attorney, Agent, or Firm* — Knobbe, Martens, Olson & Bear LLP

(57) ABSTRACT

A flat bag storing a liquid-impregnated sheet-shaped object has on its top side a joined part constituted by two films sealed together. The sealed part forming the joined part is formed at the base of the joined part over the entire length of the joined part. The edge of the joined part is not sealed but forms a non-sealed part instead, and the end edge of one of the two films constituting the non-sealed part is formed longer than the end edge of the other film. The flat bag simplifies the operation of spreading a folded-up sheet stored therein by removing the sheet from the flat bag and allowing the removed sheet to be attached on the face quickly and reliably without dirtying the fingers.

10 Claims, 8 Drawing Sheets

(51) Int. Cl.

| | |
|---|---|
| ***A45C 7/00*** | (2006.01) |
| ***A45D 40/00*** | (2006.01) |
| ***A45D 44/00*** | (2006.01) |
| ***A45D 44/22*** | (2006.01) |
| ***B65D 81/22*** | (2006.01) |
| ***A45C 11/00*** | (2006.01) |

(56) References Cited

U.S. PATENT DOCUMENTS

| | | | | |
|---|---|---|---|---|
| 5,569,230 | A * | 10/1996 | Fisher | A61F 13/47218 206/438 |
| 6,945,402 | B1 * | 9/2005 | Gueret | B65D 81/3272 206/219 |
| 7,631,766 | B2 * | 12/2009 | Wang | B65D 81/3272 206/222 |
| 2004/0026287 | A1 * | 2/2004 | Tsai | G02C 13/006 206/440 |
| 2004/0026289 | A1 * | 2/2004 | Halkyard | A61B 1/126 206/494 |

FOREIGN PATENT DOCUMENTS

| | | | |
|---|---|---|---|
| JP | 3159278 | U | 5/2010 |
| JP | 2011-172732 | A | 9/2011 |
| JP | 2012-106748 | A | 6/2012 |
| JP | 2013-512154 | A | 4/2013 |
| WO | WO 2011/064901 | A1 | 6/2011 |

* cited by examiner (a)

(b)

(c)

FLAT BAG STORING SHEET-SHAPED OBJECT

TECHNICAL FIELD

This application is the U.S. National Phase under 35 U.S.C. §371 of International Application PCT/JP2013/077156, filed Oct. 4, 2013, which claims priorities to Japanese Patent Applications No. 2012-222101, filed Oct. 4, 2012 and No. 2013-208507, filed Oct. 3, 2013. The International Application was published under PCT Article 21(2) in a language other than English.

The present invention relates to a flat bag storing a sheet-shaped object.

More particularly it relates to a sheet-storing flat bag in which a wet sheet, face mask, etc., impregnated with liquid cosmetic material, chemical solution, etc., is stored.

BACKGROUND ART

It is known that, for example, a wet sheet, face mask, etc., is impregnated with cosmetic material, chemical solution, etc., and this wet sheet, face mask, etc., is individually packaged in a flat bag so that when the wet sheet, face mask, etc., is to be used, the package is opened to remove the object inside. These individual packages can prevent drying, bacterial growth, and attachment of contaminants compared to when multiple wet sheets, face masks, etc., are collectively packaged in a single bag.

However, individual packages mean the flat package bags must be opened individually at the time of use. To open a package, the flat bag is torn open from one end where a triangular notch, etc., for tearing by fingers is provided, after which the fingers or hand are/is inserted through the opening thus formed and the wet sheet, face mask, etc., inside the flat bag is grasped with the fingertips and pulled out, and then the wet sheet, face mask, etc., which is normally folded, is opened with the fingers while being grasped and put over the face or other area where it is used.

Since the wet sheet, face mask, etc., is impregnated with liquid, however, spreading the folded sheet is not easy as the folded pieces stick together, for example.

Also before use, or particularly when the fingers or hand are/is inserted from the opened end of the package, the cosmetic material or chemical solution attached to the interior face of the flat package bag attaches to the fingers other than those grasping the wet sheet, face mask, etc., as well as to the palm and back of the hand.

This means that, when using the wet sheet, face mask, etc., the cosmetic material or chemical solution attached to wide areas including the fingers other than those grasping the sheet, pack, etc., and the palm and back of the hand, etc., must be wiped off using tissue papers, etc., which translates to poor utility.

In addition, spreading the wet sheet, face mask, etc., while being grasped can cause the sheet to wrinkle unintentionally or tear if the sheet is weak, and spreading the grasped sheet itself results in reduced workability.

Moreover, when a wet sheet, particularly one of small area (such as a point care pad or point mask), is individually packaged into a flat bag or other bag-shaped package, the opening created in the bag-shaped package is also small and this causes the cosmetic material or chemical solution to attach to even wider areas on the fingers that are inserted to remove the wet sheet of small area, thus reducing utility further.

BACKGROUND ART LITERATURE

Patent Literature

[Patent Literature 1] Japanese Patent Laid-open No. 2011-172732

SUMMARY OF THE INVENTION

Problems to be Solved by the Invention

As mentioned above, conventional individually packaged wet sheets, face masks, and other sheets cannot be removed from the flat package in a satisfactory manner and as the fingers are inserted in the flat bag, etc., not only the fingertips grasping the sheet but also other fingers and the palm and back of the hand get messy by the cosmetic material, etc. Accordingly, one object of the present invention is to minimize the dirtying of the fingers and hand, except for the fingertips grasping the sheet, when the sheet is removed from the flat bag.

Another object of the present invention is to allow the folded sheet, which has been removed from the bag and is ready for use in the spread form, to be easily and reliably spread so that the removed sheet can be put on the face, etc., promptly without dirtying the fingers or causing the sheet to wrinkle or tear.

Means for Solving the Problems

The present invention achieves the aforementioned objects by adopting a specific storage bag in which a wet sheet, face mask, or other sheet is stored; to be specific, it adopts the means explained below:

1. A flat bag storing a liquid-impregnated sheet-shaped object and having on its top side a joined part constituted by two films sealed together, wherein a sealed part forming the joined part is formed at the base of the joined part over the entire length of the joined part, the edge of the joined part is not sealed but forms a non-sealed part instead, and the end edge of one of the two films constituting the non-sealed part is formed longer than the end edge of the other film.
2. A flat bag storing a liquid-impregnated sheet-shaped object according to 1, wherein the shape of the sealed part has a convex part pointing toward the non-sealed part.
3. A flat bag storing a liquid-impregnated sheet-shaped object according to 1 or 2, wherein the sheet-shaped object stored in the flat bag has folded edges and the folded edges are positioned on the top side or bottom side of the flat bag.
4. A flat bag storing a liquid-impregnated sheet-shaped object according to 3, wherein the liquid-impregnated sheet-shaped object is stored in a folded-up state and the folded-up sheet-shaped object is formed by gatefolding a flat sheet-shaped object and then folding the gatefolded sheet in such a way that the joint comes to the inside and that a fold line running perpendicular to the gatefold line is formed, after which the sheet-shaped object is placed inside the bag in such a way that the fold lines created by the gatefold run parallel with the joined part and that the joint formed by the gatefold does not face the joined part side.
5. A flat bag storing a liquid-impregnated sheet-shaped object according to 3, wherein the liquid-impregnated sheet-shaped object is stored in a folded-up state and the folded-up sheet-shaped object is formed by half-folding a flat sheet-shaped object and then gatefolding the half-folded sheet along two lines running perpendicular to the half-fold line, after which the sheet-shaped object is placed inside the bag in such a way that the fold lines created by the gatefold run parallel with the joined part and that the joint formed by the gatefold faces the joined part side.

EFFECTS OF THE INVENTION

The flat bag storing a sheet-shaped object as proposed by the present invention is an individual package whose contents, or an unused wet sheet, face mask, etc., impregnated with cosmetic material or chemical solution, is preserved in a sealed state to prevent drying or deterioration, and when the wet sheet, face mask, or other sheet is to be used, the sheet-storing flat bag can be opened by a specific means so that the sheet can be removed easily without excessively dirtying the fingers or hand, and furthermore the removed sheet can be spread easily and reliably without excessively dirtying the fingers.

DESCRIPTION OF THE SYMBOLS

Figure 1:
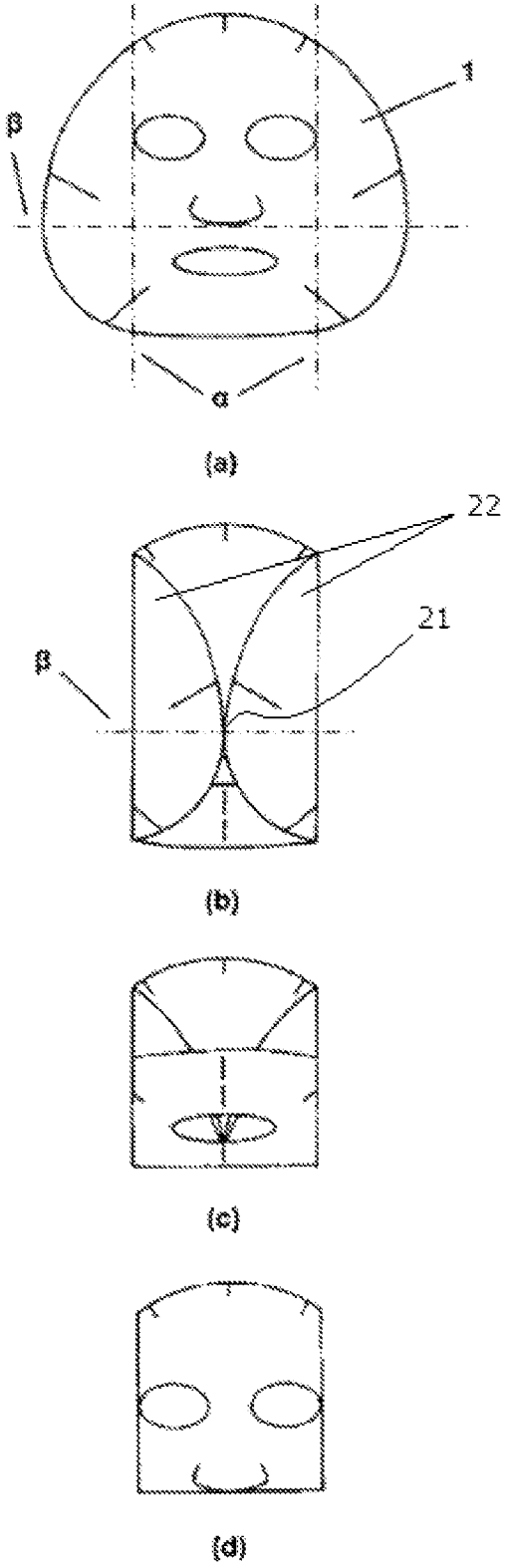
FIG. 1 Process chart showing how a face mask is folded up
FIG. 2*a* Drawing showing a face mask inserted in a flat bag
FIG. 2*b* Drawing showing a face mask inserted in a flat bag
FIG. 2*c* Drawing showing a face mask inserted in a flat bag
FIG. 2*d* Drawing showing a face mask inserted in a flat bag
FIG. 3 Drawing showing a flat bag before it is opened
FIG. 4 Drawing showing a face mask being removed from an opened flat bag
FIG. 5 Drawing showing a folded-up face mask
FIG. 6 Drawings showing how a face mask is spread
FIG. 7 Drawing showing another example of a flat bag that has been opened
FIG. 8 Drawing showing a partially unfolded face mask
FIG. 9 Drawing showing a face mask before it is lifted up
FIG. 10 Drawing showing a face mask being lifted up
FIG. 11 Drawing showing a face mask almost completely lifted up
FIG. 12 Drawing showing a face mask completely lifted up

1: Face mask
2: Side
3: Side
4: Side
5: Joined part
6: Sealed part
7: Sealed part
8: Opening
9: Non-sealed part
10: Sealed part
11: Grasping part
21: Joint
22: Sheet piece
23: Edge Mode For Carrying Out The Invention The present invention is a flat bag storing a sheet-shaped object and having a joined part provided on the top side, wherein the flat bag is opened from the joined part. Face masks and wet sheets impregnated with cosmetic material or chemical solution may be collectively referred to as a sheet or sheet-shaped object.

The present invention is explained based on two drawings showing specific examples.

First Specific Example

FIG. 1 is a face mask 1 representing an example of sheet-shaped object to be stored in a sheet-storing flat bag according to the present invention.

First, FIG. 1(*a*) shows the face mask 1. In this drawing, the face mask 1 is valley-folded along the two two-dot chain lines a running vertical next to the holes where the eyes should be, which effectively gatefolds the sheet into the condition shown in FIG. 1(*b*).

In FIG. 1(*b*), the two-dot chain line β running horizontal below the nose part of the face mask 1 is valley-folded to achieve the condition shown in FIG. 1(*c*). As a result, a fold line running perpendicular to the gatefold lines is formed with the joint of the gatefolded face mask 1 coming to the inside. FIG. 1(*d*) shows the folded mask after it is turned over.

Needless to say, the method for folding the face mask is not limited to the folding method shown in FIG. 1 and the folded shape is not limited, either. As explained later, any folding method can be used without limitation so long as the removed face mask can be easily spread.

Figure 2A:
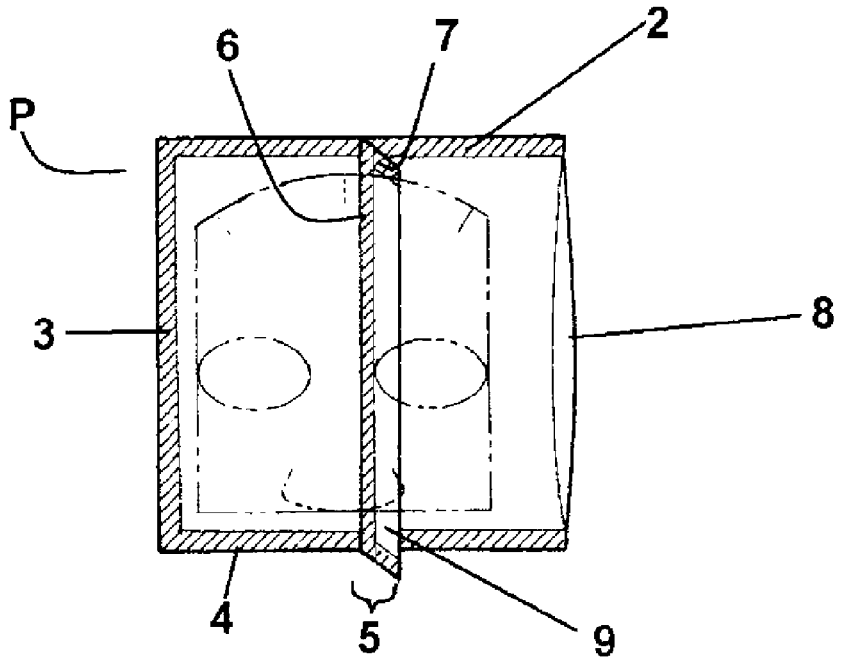

The face mask or wet sheet thus folded up is stored inside the sheet-storing flat bag P as shown in FIG. 2*a*. FIG. 2*a* is a drawing showing the stage before the sheet-shaped object is inserted into the flat bag P through an opening 8 and sealed. Any known means for insertion can be adopted as desired. In this condition, the sheet is placed inside the flat bag P in such a way that the gatefold lines denoted by the two-dot chain lines a run parallel with a joined part 5, and the joint formed by the gatefold does not face the joined part 5.

The sheet-storing flat bag P shown in FIG. 2*a* is formed by sealing its three sides 2, 3, 4 by means of heat seal, bonding, etc. Needless to say, it may be constituted without sealing three sides, but by lines formed by folding the material films only on one side or two sides, depending on how the material films for sheet-storing flat bag P are folded up. Such films may use any known flat bag material that does not allow liquid content to permeate through.

In essence, it is necessary to provide beforehand on one side of the sheet-storing flat bag P an opening 8 through which a face mask or wet sheet material can be inserted, and provide a joined part 5 by sealing two films together, with its three sides 2, 3, 4 sealed by means of heat seal, etc., or the material films folded along these sides. Here, with regard to the use of two films as mentioned above, any film can be used so long as a joined part can be formed, and a joined part can be formed by sealing two films together as mentioned.

Here, the structure of the joined part 5 is such that, a sealed part 6 for forming the joined part 5 is provided by means of heat seal or bonding at the base of the joined part 5 where it is joined to the sheet-storing flat bag P.

Here, the sealed part 6 does not seal the entire joined part 5 and, while a sealed part 7 can be provided on the side of the joined part 5 if desired, a non-sealed part 9 must be provided on the outer side of the sealed part 6, or specifically on the side of a step part A of the joined part 5 as described below.

After the sheet-shaped object is stored in the sheet-storing flat bag P, the opening 8 is sealed by means of heat seal, bonding, or other known means to manufacture a flat bag storing a sheet-shaped object.

The base of the joined part mentioned herein refers to the area of the joined part other than its edge, while the edge of the joined part refers to the non-sealed part extending over the entire length of the joined part along the entire length of the flat bag including the edges of the two sheets used to form the joined part.

Figure 2B:
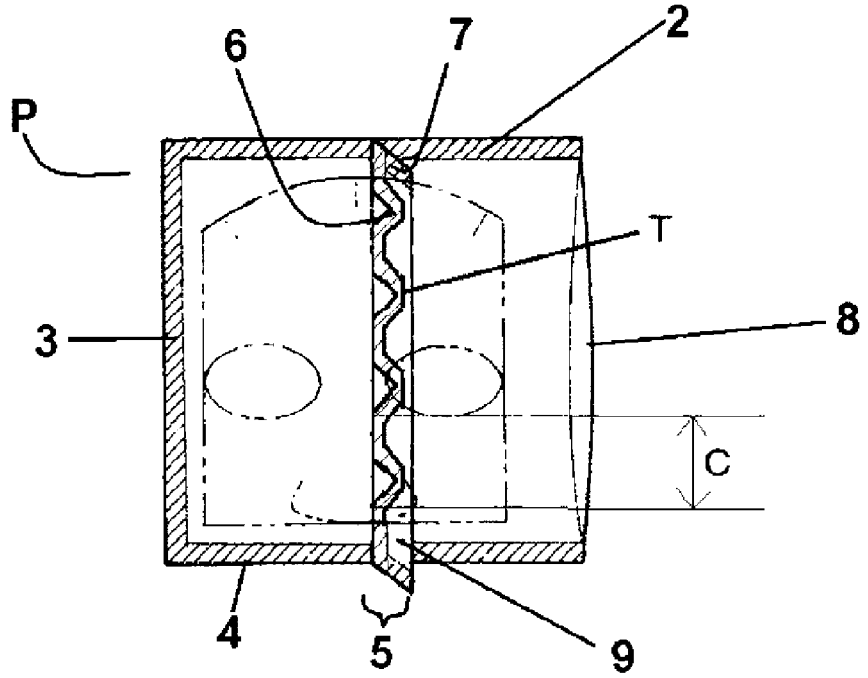

In addition, a straight sealed part can be formed along the joined part 5 just like the sealed part 6 shown in FIG. 2*a*, or a sealed part 6 zig-zagging in a pattern of repeated quasi-triangles with their apexes truncated can be provided along the entirety of the joined part 5 as shown in FIG. 2*b*. Even when a sealed part is provided in a quasi-triangle pattern, a non-sealed part 9 must be provided outside apexes T just like in FIG. 2*a*. The sealed part can also have a wave pattern instead of a quasi-triangle pattern.

If a sealed part of quasi-triangle pattern or wave pattern is to be provided in one part of the joined part 5, it can be provided at the center of the joined part in the length direction or near the side 2. Of the two, the center of the joined part in the length direction, or specifically the center position with respect to the sides 2, 3, is preferred as it facilitates opening.

In addition, providing a non-sealed part ensures that, when the joined part is opened with the fingers, the non-sealed part is opened first and at the same time a force to open the joined part is applied to the apexes T of the sealed part of quasi-triangle pattern, which allows for easy opening of the sealed part 6 even when the finger strength to pull the joined part is weak.

While FIG. 2*b* shows a sealed part 6 shaped in quasi-triangles with their apexes truncated, it can have a wave shape or may be shaped in quasi-triangles without their apexes truncated. It is also possible to repeat regular quasi-triangles or waves or combine irregular quasi-triangles or waves.

In essence, a force to open the joined part must be applied to the apexes T of the sealed part 6 of quasi-triangle or wave pattern at the time of opening.

If the sealed part 6 is shaped in a pattern of repeated quasi-triangles or waves as shown in FIG. 2*b*, for example, these quasi-triangles or waves can have a height of 5 to 20 mm, or preferably 8 to 15 mm. In addition, the quasi-triangles or waves can be repeated at a cycle C of 5 to 20 mm, or preferably 8 to 20 mm, in length.

Moreover, while the sealed part 6 can have a cyclical shape as mentioned above, it is also possible to form the sealed part 6 in a single hill-shape that rises toward the center. Furthermore, although not illustrated herein, two or more of such a hill-shape can be arranged side by side.

Figure 2C:
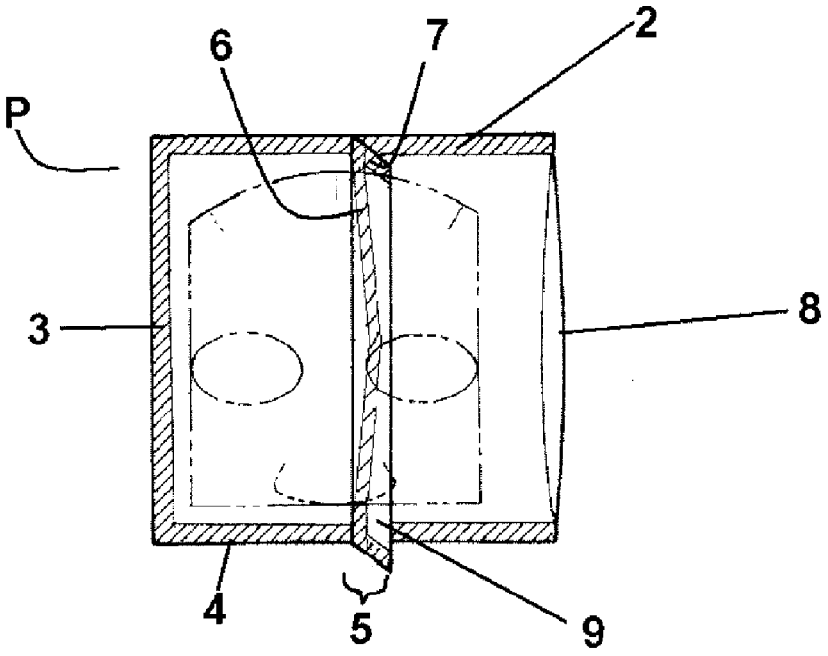
Figure 2D:
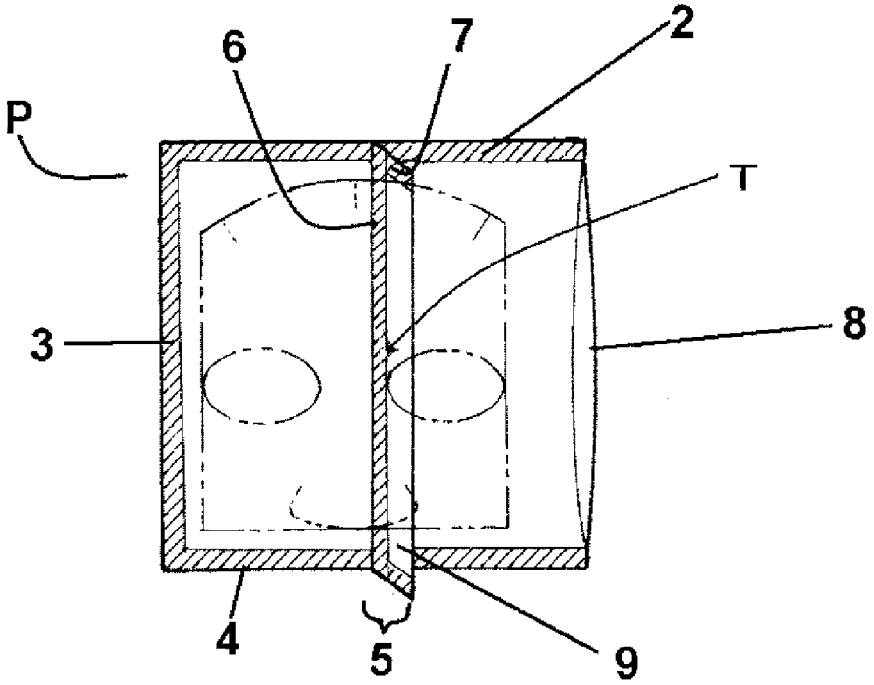

Another example is that, as shown in FIG. 2*d*, the shape of the sealed part 6 shown in FIG. 2*a* is used as the base and it is modified by providing an apex T, which is a convex-shaped sealed part, at roughly the center of the sealed part 6 or other location.

According to FIGS. 2*c* and 2*d*, when the joined part is opened a force is applied first to the convex part corresponding to the apex of the hill-shape of the sealed part. Since this convex part has small sealed area, the force needed to separate this part is smaller.

By shaping the sealed part as having a convex part or other apex pointing toward the non-sealed part so that this apex is opened first, as explained above, the force needed to open the entire sealed part 6 can be reduced further.

The apex T is only one type of convex part under the present invention and, when the sealed part has a wave pattern instead of the aforementioned quasi-triangle pattern, the apexes of the waves can be shaped as one type of convex part and the apex provided along the sealed part shown in FIG. 2*d* can also be shaped as a convex part.

For example, in FIG. 2*a* the opening 8 can be sealed and the side 2 or 4 open so that the sheet-shaped object is inserted through this opening. In this case, one film can be folded, and sealed if necessary, to form the joined part 5 beforehand. In this case, the joined part 5 is effectively formed by sealing both ends of one film.

Heat seal, bonding or other known means can be adopted when providing any of these sealed parts.

Figure 3:
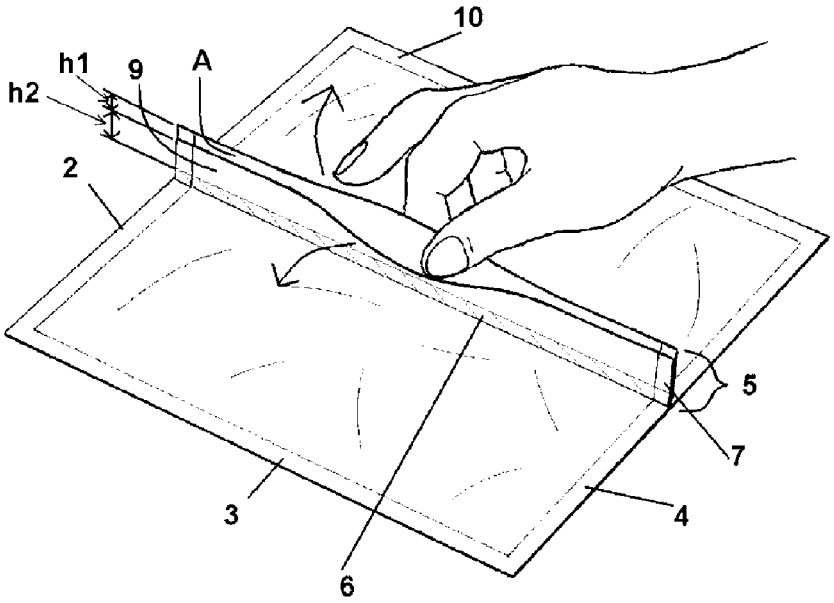

Next, the steps to open and use a flat bag storing a sheet-shaped object as proposed by the present invention are explained using FIG. 3 and the figures that follow.

FIG. 3 is a drawing showing a flat bag storing a sheet-shaped object, with fingertips inserted into the non-sealed part 9 of its joined part 5 to open the part. Here, the non-sealed part 9, which is located adjacent to the sealed part 6, is where the two material films constituting the flat bag are not sealed, where the two films do not have the same height from the sealed part 6 but one of the two film members is set higher than the other film member and, in FIG. 3, a step A of certain height h1 is formed.

When inserting fingertips into the non-sealed part 9, presence of a sufficient step A facilitates the insertion of fingertips into the non-sealed part 9, compared to when there is no step A, because the fingertips can be moved along the step A to feel the point where the non-sealed part 9 should be opened. Such step A has a height hl of 3 to 10 mm, or preferably 5 to 8 mm. A step smaller than 3 mm can make it difficult to feel the point to open the non-sealed part 9, while a step larger than 10 mm does not provide any benefit other than making it easier to insert the fingertips sufficiently.

This step A is provided regardless of the shape of the sealed part 6.

At the same time, the height of the non-sealed part 9, or h2, must also be sufficient because, if the height h2 of the non-sealed part 9 is low, the fingertips cannot be inserted sufficiently into the non-sealed part 9 and this makes it difficult to subsequently grasp the non-sealed part 9 with the fingertips to open the non-sealed part 9. The height h2 of the non-sealed part 9 corresponds to the length from its boundary with the sealed part 6 to the edge of the lower of the two films forming the step A. This height h2 of the non-sealed part 9 is 5 to 15 mm, or preferably 5 to 10 mm. If the height h2 of the non-sealed part 9 is smaller than 5 mm, inserting fingertips into the non-sealed part without affecting the ease of the operation may become difficult, while a height greater than 15 mm does not improve the ease of the operation further.

If the sealed part 6 has a quasi-triangle or wave pattern, the length from the tip of the apex T of the quasi-triangle or wave to the edge of the lower of the two films forming the step A is defined as the height h2 of the non-sealed part 9.

By grasping this non-sealed part 9, grasping the two film pieces forming the non-sealed part 9 with the fingers of both hands, and then pulling the respective film pieces in the directions of the arrows, the heat-sealed or bonded area of the sealed part 6 adjacent to the non-sealed part 9 is separated and the sealed part 6 becomes no longer sealed, thereby forming an opening at the sealed part 6, and by further pulling in the directions of the arrows, the heat-sealed or bonded areas also are detached along the sides 2, 4, spreading to expand the opening.

If the sealed part 6 has a quasi-triangle or wave pattern, the non-sealed part 9 is grasped first, two film pieces forming the non-sealed part 9 are grasped with the fingers of both hands, and then the respective film pieces are pulled in the directions of the arrows, to separate the heat-sealed or bonded area of the sealed part 6 from the apex T of the quasi-triangle or wave or a nearby point as mentioned above. Since the area of the heat-sealed or bonded location separated first from the apex T or a nearby point is small, the required separation force is smaller.

Figure 4:
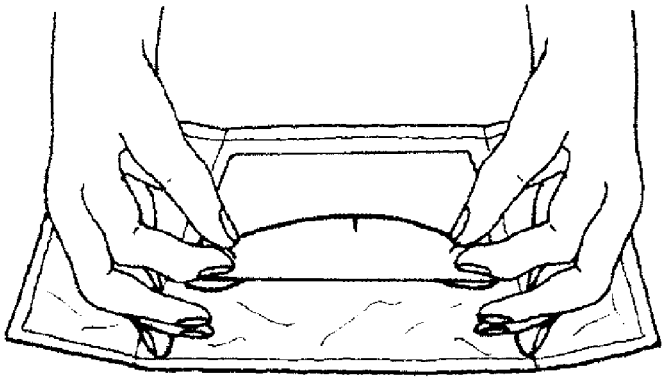

FIG. 4 shows the condition at the end of spreading, with the opening expanded and sides 2, 4 separated sufficiently.

In the condition at the end of spreading, the folded-up face mask or wet sheet stored in the flat bag is positioned on the spread-out bag. By grasping the folded-up face mask or wet sheet with both hands or one hand and lifting it up, the folded-up face mask or wet sheet can be removed from the flat bag.

Figure 5:
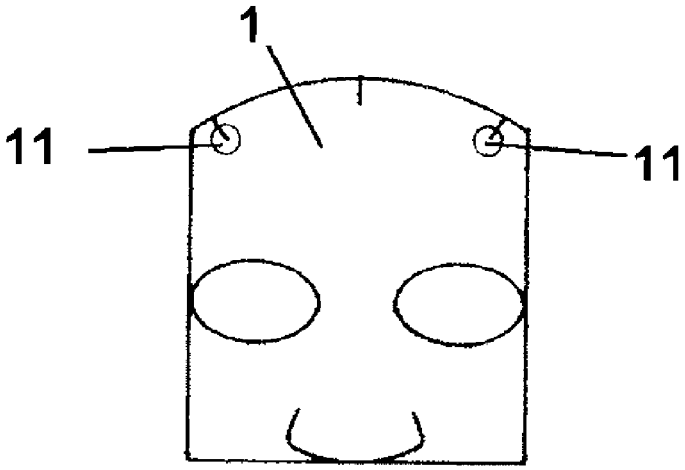

FIG. 5 shows an example of the face mask lifted up in FIG. 4.

The face mask 1 described in FIG. 5 is spread into a face mask when the circled locations are grasped with fingers and the fold lines become unfolded.

Figure 6:
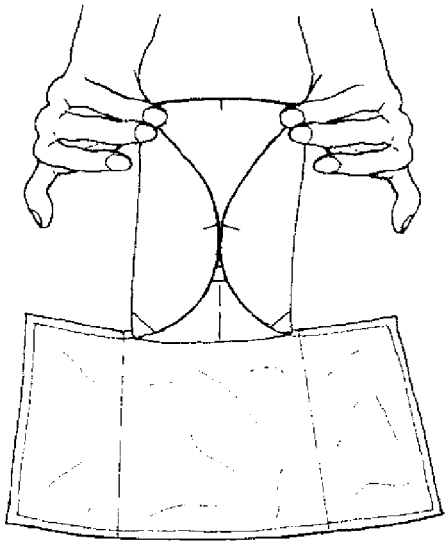
Figure 6:
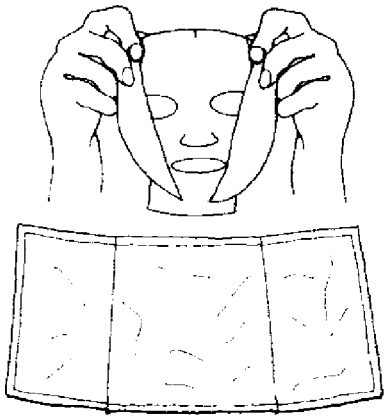
Figure 6:
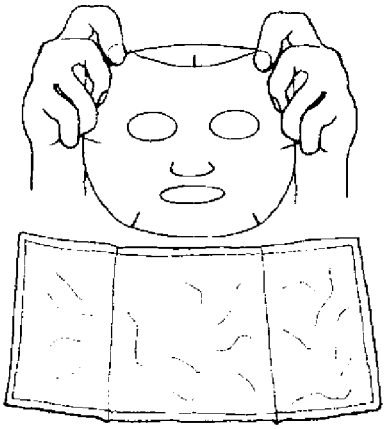

This is shown in FIG. 6. FIG. 6(*a*) shows that the face mask that has been lifted up by the fingers is being spread, where the folded-up face mask is spread as shown in FIG. 6(*b*) due to its own weight or as the fold lines made at the time of storage become unfolded. The face mask thus spread is now ready to be placed on the face, as shown in FIG. 6(*c*).

Needless to say, the face mask or wet sheet can be spread further using other finger or fingers or by any other operation if not yet spread enough.

Second Specific Example

In the second specific example, the structure of the flat bag is the same as in the first specific example, but how the stored sheet-shaped object is folded and positioned are different.

Figure 7:
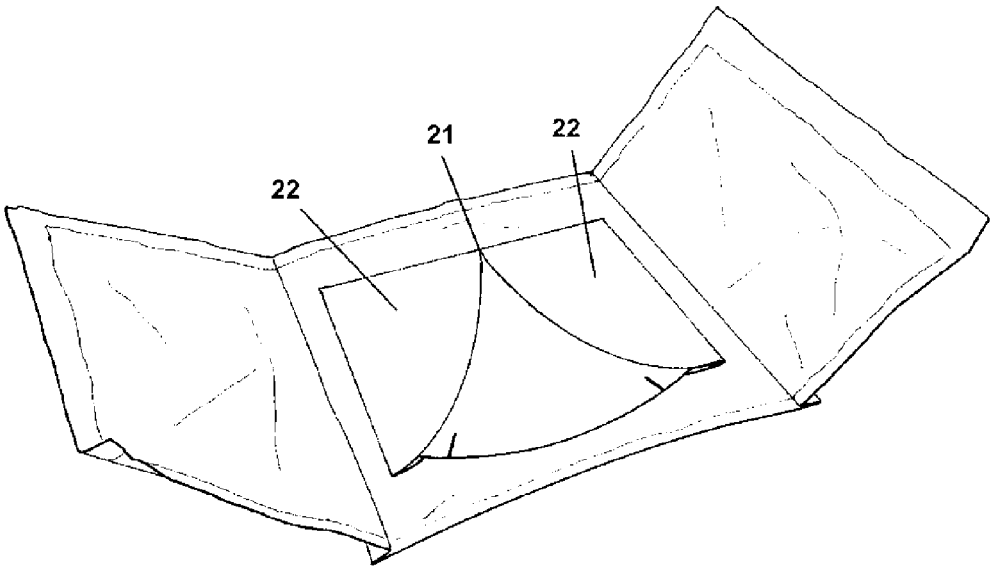

To be specific, when the flat bag is opened from the joined part, the stored face mask or wet sheet is such that its two sheet pieces 22 are folded in such a way that a joint 21 formed by the gatefold comes to the top side, as shown in FIG. 7.

Here, this folding method involves valley-folding the face mask in FIG. 1 along the two-dot chain line denoted by β first, and then valley-folding it along the two-dot chain lines denoted by α.

Figure 8:
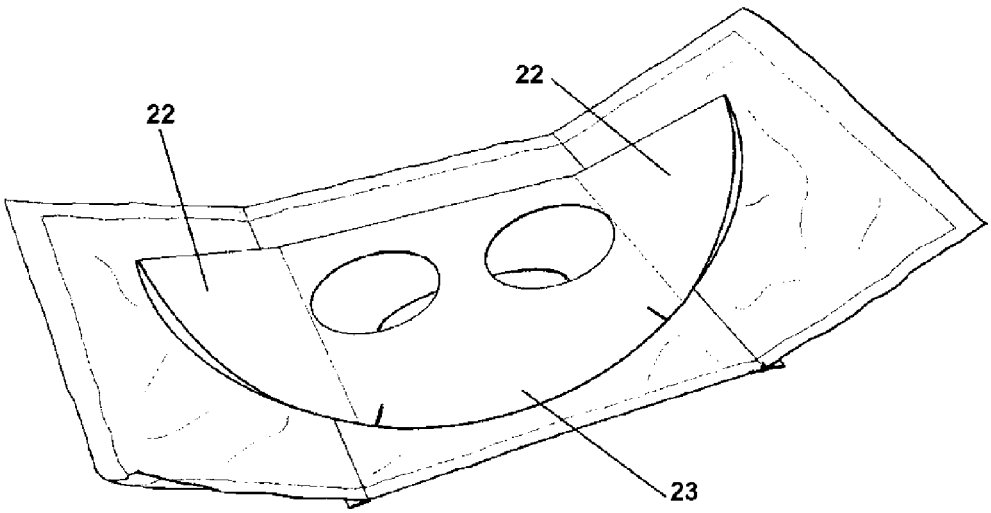

Thereafter, the user spreads the folded sheet pieces 22 into the condition shown in FIG. 8. To achieve this condition in FIG. 8, the edges of the sheet pieces 22 in the condition of FIG. 7 are grasped with fingers and spread to both sides on the opened flat bag. Until this stage, the sheet is manipulated on the opened flat bag. In this condition, an edge 23 of the half-folded face mask or wet sheet is such that the top layer of the folded face mask or wet sheet projects from the bottom layer in direct contact with the interior face of the flat bag, which is more desirable as the face mask or wet sheet can be subsequently grasped with ease.

Figure 9:
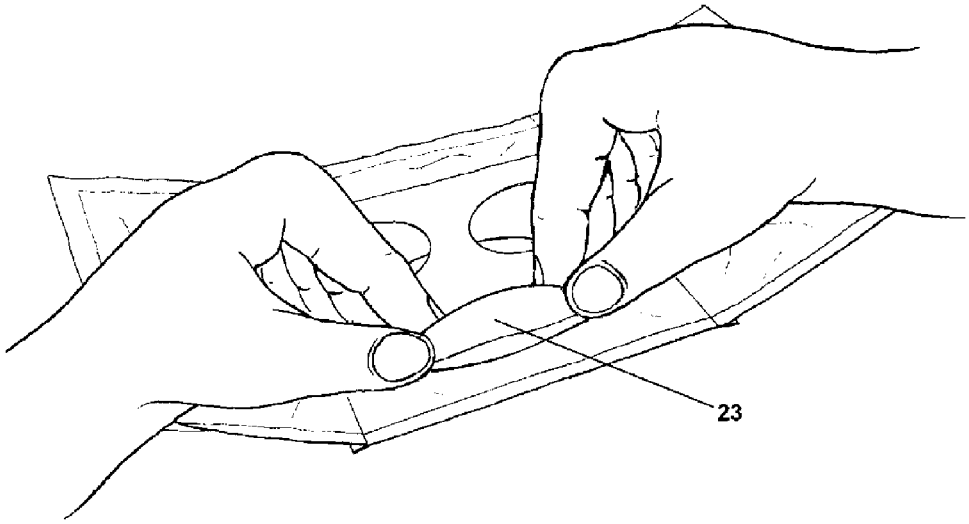

Next, as shown in FIG. 9, the user grasps the edge 23 of the top layer and lifts it up to spread the folded-up face mask or wet sheet. At this time, the bottom layer of the face mask or wet sheet remains attached to the flat bag due to the viscosity, etc., of the impregnated cosmetic material or chemical solution and thus the bottom layer of the face mask or wet sheet is not lifted up together with the top layer, which ensures smooth spreading.

Figure 10:
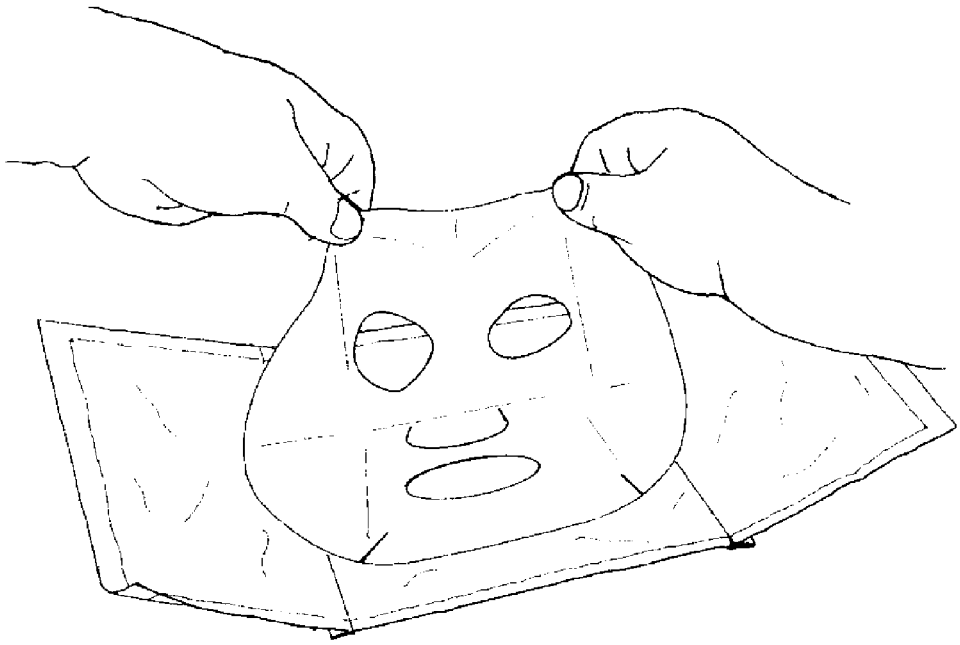

FIG. 10 shows the condition of the edge 23 of the top layer while being lifted up. In this condition, roughly a half of the face mask or wet sheet is attached to the interior face of the flat bag, with the remaining half grasped and lifted up by the user.

Figure 11:
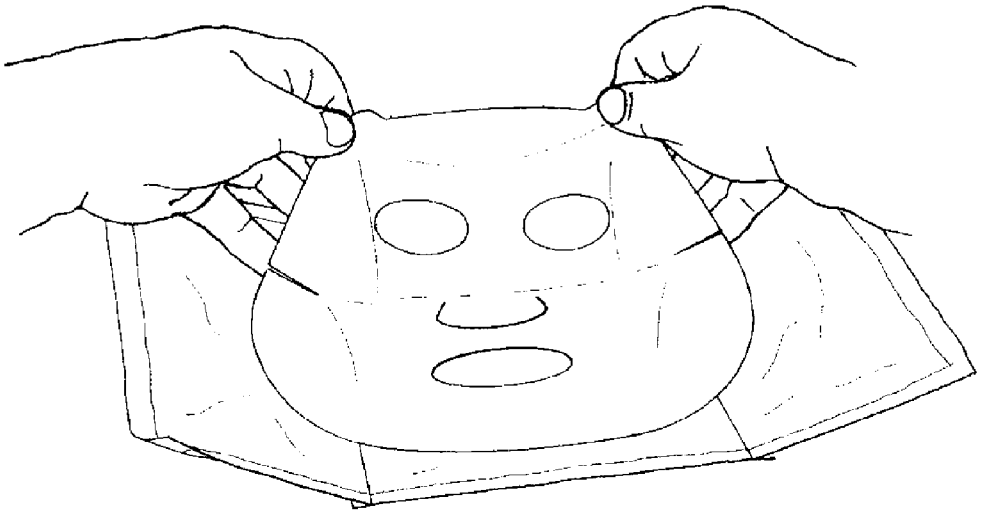
Figure 12:
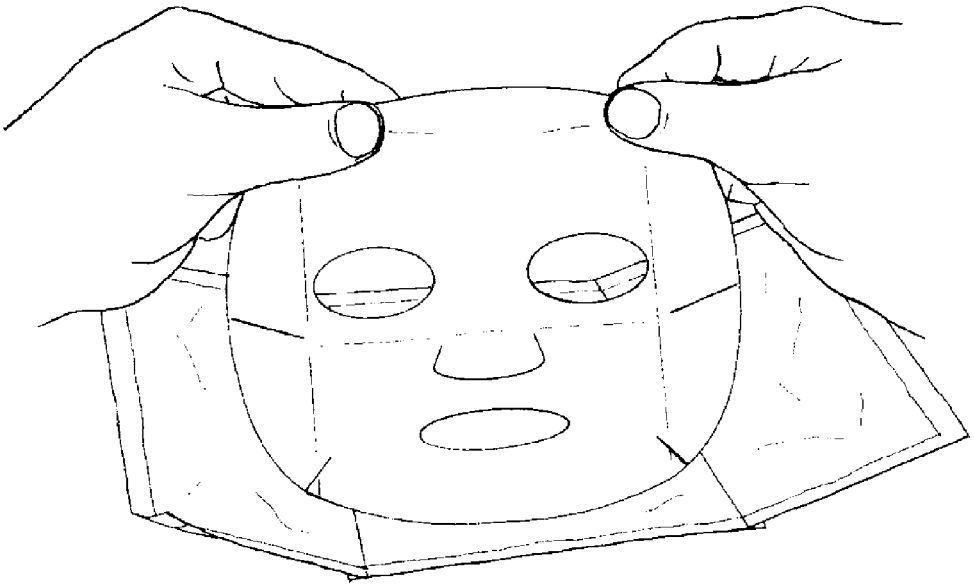

As the fingers grasping the face mask or wet sheet are pulled up continuously, the face mask or wet sheet is lifted up as shown in FIG. 11 and eventually the face mask or wet sheet is completely removed from the flat bag as shown in FIG. 12.

The user can place the face mask or wet sheet directly over his/her face in the condition of FIG. 12 without repositioning it on the fingers, for example.

According to this second specific example, the face mask or wet sheet can be removed by opening the joined part of the flat bag and opening the edge 23, and then used directly without releasing the fingers or repositioning the face mask or wet sheet on the fingers, which allows for easy and reliable removal from the flat bag and use of the face mask or wet sheet and also prevents other fingers, etc., from getting dirtied.

The examples illustrated by these drawings are those wherein the sides 2, 4 of the flat bag are constituted by a film and integrated by heat-sealing or bonding the film to the extent that they are still separable. In the case of the flat bag proposed by the present invention, where these sides 2, 4 are separated by spreading the non-sealed part 9, the side 3 need not be formed by means of heat seal or bonding and this side may be formed by folding a single film.

Also with respect to the size of the sealed part 6, the sealed part 6 requires certain bonding area and bonding force just like other sealed parts so that the flat bag proposed by the present invention can seal the content without fail. The sealed part 6 can be provided at the base of the joined part, but it can be offset toward the edge of the joined part, if necessary.

As for the size of the non-sealed part 9, it must be large enough to apply forces to the sealed part 6 in the directions of the arrows shown in FIG. 3 to allow the sealed part 6 to be unsealed at the time of opening.

For the material film for this flat bag, any known material that can be made into a flat bag while storing a wet sheet-shaped object in an airtight manner can be adopted. Such material may be a laminate film constituted by multiple resin layers, or laminate film having an aluminum or other metal layer or layers, for example.

In addition, any face mask or wet sheet used for other purposes or only on a part of the face can be used instead of the face mask illustrated by the drawings, because the sheet to be stored in the sheet-storing flat bag proposed by the present invention is not limited to a full-face mask.

In the case of a wet sheet impregnated with liquid, a makeup removal sheet, wet sheet, wet tissue, cleaning wipe for windows of buildings or vehicles, interiors, etc., cleaning sheet for humans and pets, wet wipe, sterilizing/antibacterial sheet, sheet impregnated with any type of chemical solution, cleaning agent, etc., sheet coated with powder makeup or other powder, or any other sheet that can be removed and used individually can be used.

The material constituting the sheet is not limited in any way, but it is required to have enough flexibility to be folded and not to break or otherwise sustain damage when the folded edge is pulled.

Such sheet material is not limited in any way so long as it constitutes a sheet-shaped object that can be folded, such as paper, resin sheet, metal sheet, woven or non-woven fabric made from organic compound or inorganic compound, and the sheet may be dry or wet. It can also be a dry sheet on which makeup powder or powdery chemical agent is attached.

If a wet sheet is stored in the flat bag under the present invention, the base material of the sheet can be a liquid-absorbent sheet, as a rule, where a knit, woven, non-woven or other fiber sheet, paper, or foam material, can be used, for example. Among foam sheets, a fiber sheet primarily made of cotton, pulp, rayon, or other natural fibers is preferred in terms of economy and safety on the skin, although a polyurethane foam, NBR foam, or other sponge sheet offering excellent liquid absorbency and retention property can also be used. As for the manufacturing method of the sheet, a method that uses a knitting machine or resin molding machine, any of various non-woven fabric forming methods, or other known method can be used.

In addition to the above, a laminate such as a laminate sheet constituted by fiber, foam, and/or synthetic resin sheets can also be used. Use, as the base material, of a sheet constituted by thin synthetic resins layered on one side is preferred because the water repellency of the synthetic resin sheet improves the ease of separation further even in a wet state.

The wet sheet under the present invention can have any desired shape, such as a circle, oval, comma, or polygon, and while a folded-up wet sheet is preferred as the folded parts spread naturally to open the sheet when the sheet is grasped with fingers and lifted up, the sheet need not be folded up. Regardless of whether or not it is folded up, a face mask or wet sheet can be positioned over the opened bag according to the present invention, meaning that the flat bag under the present invention can be used as an underlay when the face mask or wet sheet is used.

While the impregnated liquid is cosmetic material, etc., in the case of a face mask, it is not limited in any way in the case of a wet sheet that can be impregnated with water, skin lotion, chemical solution, cleaning agent, etc., and preferably a wet sheet is made by impregnating it with a substance that does not corrode or otherwise eat away the sheet material and sheet-storing flat bag.

Under the present invention, any known cosmetic material, chemical solution or cleaning agent can be impregnated into or attached to the wet sheet when it is stored. In terms of properties, a substance in any state such as liquid, paste, cream, gel, or powder can be used, where the applicable examples include: skincare products such as face wash agents, skin lotions, and skin milks; makeup products such as face powders, foundation, and cheek color; various cosmetic materials such as aromatics, cosmetics, skin whitening agents, anti-oxidative agents, anti-wrinkle agents, moisturizing agents, sunscreen agents, baby powders, hair removal agents, anti-bacterial agents, sterilizing agents, and acne treatment agents; chemical agents; and surface-active agents, among others. As for the form of cosmetic materials, chemical solutions, cleaning agents, etc., that can be used favorably under the present inventions, liquid or semi-liquid such as creams or gels of varying viscosity are suitable.

As for the retained amount of cosmetic material, chemical solution, or cleaning agent, a preferred range is 30 to 500 percent by weight of the weight of the base material of the wet sheet. If the cosmetic material, etc., is in a liquid state, using it by 30 percent by weight or less does not allow a sufficient amount to be applied to achieve efficient application, while using it by more than 500 percent by weight causes excess liquid applied beyond the liquid retention capacity of the wet sheet to drip and collect at the bottom of the flat bag easily.

The invention claimed is:

1. A flat bag package comprising a flat bag and a liquid-impregnated sheet-shaped object stored inside the flat bag, said flat bag having on a top side a joined part constituted by two films sealed together, wherein a sealed part forming the joined part is formed at a base of the joined part over an entire length of the joined part, an edge of the joined part is not sealed but forms a non-sealed part instead, and an end edge of one of the two films constituting the non-sealed part is formed longer than an end edge of the other film, and a length from a boundary between the non-sealed part and the sealed part to the end edge of the other film is 5 to 15 mm, wherein the sheet-shaped object stored in the flat bag has folded edges and the folded edges are positioned on a top side or bottom side of the flat bag.

2. A flat bag package according to claim 1, wherein the liquid-impregnated sheet-shaped object is stored in a folded-up state and the folded-up sheet-shaped object is formed by gatefolding a flat sheet-shaped object and then folding the gatefolded sheet in such a way that a joint comes to an inside and that a fold line running perpendicular to a gatefold line is formed, after which the sheet-shaped object is placed inside the bag in such a way that the fold lines created by the gatefold run parallel with the joined part and that the joint formed by the gatefold does not face the joined part side.

3. A flat bag package according to claim 1, wherein the liquid-impregnated sheet-shaped object is stored in a folded-up state and the folded-up sheet-shaped object is formed by half-folding a flat sheet-shaped object and then gatefolding the half-folded sheet along two lines running perpendicular to the half-fold line, after which the sheet-shaped object is placed inside the bag in such a way that the fold lines created by the gatefold run parallel with the joined part and that the joint formed by the gatefold faces the joined part side.

4. A flat bag package according to claim 1, wherein a shape of the sealed part has a convex part, a middle portion of which points toward the non-sealed part, and the sheet-shaped object stored in the flat bag has folded edges and the folded edges are positioned on a top side or bottom side of the flat bag.

5. A flat bag package according to claim 4, wherein the liquid-impregnated sheet-shaped object is stored in a folded-up state and the folded-up sheet-shaped object is formed by gatefolding a flat sheet-shaped object and then folding the gatefolded sheet in such a way that a joint comes to an inside and that a fold line running perpendicular to a gatefold line is formed, after which the sheet-shaped object is placed inside the bag in such a way that the fold lines created by the gatefold run parallel with the joined part and that the joint formed by the gatefold does not face the joined part side.

6. A flat bag package according to claim 4, wherein the liquid-impregnated sheet-shaped object is stored in a folded-up state and the folded-up sheet-shaped object is formed by half-folding a flat sheet-shaped object and then gatefolding the half-folded sheet along two lines running perpendicular to the half-fold line, after which the sheet-shaped object is placed inside the bag in such a way that the fold lines created by the gatefold run parallel with the joined part and that the joint formed by the gatefold faces the joined part side.

7. A flat bag package according to claim 1, wherein a length between the end edge of the one of the two films constituting the non-sealed part and the end edge of the other film is 3 to 10 mm.

8. A flat bag package according to claim 4, wherein a length between the end edge of the one of the two films constituting the non-sealed part and the end edge of the other film is 3 to 10 mm.

9. A flat bag package according to claim 1, wherein the folded edges of the sheet-shaped object are symmetrically positioned in the flat bag with reference to the sides of the flat bag parallel to the sealed part.

10. A flat bag package according to claim 4, wherein the folded edges of the sheet-shaped object are symmetrically positioned in the flat bag with reference to the sides of the flat bag parallel to the sealed part.

* * * * *